United States Patent [19]

Aizenberg et al.

[11] 4,120,024

[45] Oct. 10, 1978

[54] LIGHTING INSTALLATION

[76] Inventors: Julian Borisovich Aizenberg, ulitsa Koroleva, 3a, kv. 84, Moscow; Inokh Borukhovich Bukhman, Volgogradskaya ulitsa, 31, kv. 151, Kiev; Vladimir Mikhailovich Pyatigorsky, Molodogvardeiskaya, ulitsa, 24, korpus 5, kv. 58; Natalia Mikhailovna Solomatina, ulitsa P. Korchagina, 8, kv. 114, both of Moscow, all of U.S.S.R.

[21] Appl. No.: 733,386

[22] Filed: Oct. 18, 1976

[51] Int. Cl.[2] ..... F21V 33/00

[52] U.S. Cl. ..... 362/96; 362/147; 362/216; 362/234; 362/311; 362/363

[58] Field of Search ..... 240/2 R, 3 R, 2.25; 362/96, 149, 216, 234, 311, 363

[56] References Cited

U.S. PATENT DOCUMENTS 3,621,383 11/1971 Rush ..... 240/2 R

*Primary Examiner*—Stephen J. Leichert, Jr.

*Attorney, Agent, or Firm*—Lackenbach, Lilling & Siegel

[57] ABSTRACT

A lighting installation for interior lighting of structures with pneumatic supporting members, comprising a hollow slotted light guide in the form of a supporting and shaping element of the structure. The hollow slotted light guide is of elastic film with a mirror light-reflecting coating provided on a portion of the interior surface over the entire length thereof. The other portion, which faces the interior being lighted, is a light-permeable slot. The luminous flux from one or more light sources arranged in an optical input device, which is mounted at least on one side of the light guide, is directed into the light guide, multiply reflected from the internal surface which has a light-reflecting coating and escapes through the optical slot into the interior of the structure to be lighted.

1 Claim, 12 Drawing Figures

LIGHTING INSTALLATION

The present invention relates to lighting engineering and, more particularly, to a lighting installation having a hollow slotted light guide, intended to illuminate the interior of a structure with pneumatic supporting members.

The installation of this invention can be used to illuminate workshops, hangars, exhibition halls, sports and concert halls, theaters, public buildings, as well as all types of auxiliary structures and premises, for example, warehouses and storerooms having inflatable (pneumatic) supporting members whose shape is maintained by pressurized air.

There are known systems of lighting fittings for interior lighting. In such systems, the required degree of illumination is attained through the use of individual pendants, wall or built-in fittings, or floor lamps. There are also known systems for interior lighting, which ensure uniform reflected illumination with the aid of floodlights or luminaires.

All the known lighting systems are marked in that they are of considerable weight due to their lighting fittings. The use of such systems in inflatable structures is hazardous, for they may fall in case of a drop of air pressure in the supporting members. Besides, conventional lighting systems necessiate laying electric wires on inflatable supporting members. The effectiveness of lighting systems of reflected light is limited due to a low luminous flux utilization factor. An increase in the effectiveness of such lighting systems calls for a high reflection coefficient of the internal surface of inflatable supporting members. However, if this requirement is complied with, the use of natural lighting is practically ruled out, for it calls for a high transmission factor of the shell of the inflatable structure.

There is further known a lighting installation incorporating a hollow cylindrical slotted light guide which may have different cross-sectional shapes, such as circular and elliptical. The luminous flux emitted by light sources is concentrated by optical input devices and directed through a window into the hollow slotted light guide. Part of the internal surface of said light guide is provided with a light-reflecting coating applied on the internal surface thereof by using, for example, vacuum alumetizing. The luminous flux is multiply reflected from the light-reflecting coating on the internal surface of the hollow slotted light guide and is admitted into the interior being illuminated through a light-permeable slot of a light-diffusing or transparent material. The slot extends in the lower portion of the shell, throughout the length of the hollow slotted light guide. The shape of the hollow slotted light guide is maintained with the aid of rigid ring-type shaping members, whereupon there are mounted inlet valves for the supply of pressurized air into the hollow slotted light guide, as well as outlet valves for the release of air warmed up by the light sources.

However, in order to suspend and secure the lighting installation under review, special bracing means (cables, wires, etc.) or rigid and firm supports must be employed for the hollow slotted light guide, which means and supports occupy considerable space.

It is an object of the present invention to provide a lighting installation for interior lighting of structures with inflatable supporting members, which installation dispenses with attachment means or supports which occupy much of the interior.

It is another object of the invention to provide a lighting installation free of any hazards which may result from a drop of air pressure in the supporting members.

It is yet another object of the invention to provide a lighting installation which is easy to assemble and eliminates the necessity of laying external electric wires.

The foregoing and other objects of the invention are attained by providing an installation for interior lighting of structures with pneumatic supporting members. A hollow slotted light guide with a shell of elastic film, part of the internal side surface of said light guide is provided with a light-reflecting coating extending throughout the length of said light guide, whereas the part of the shell facing the interior being lighted is a light-permeable slot. At least one optical input device is mounted on at least one ned of the hollow slotted light guide, said device incorporates at least one light source and is optically coupled to said light guide in order to direct the luminous flux from the light source into the hollow slotted light guide. Means for the supply of gas into the hollow slotted light guide through at least one inlet valve is mounted on the shell of the hollow slotted light guide, and said hollow slotted light guide is a supporting and shaping member of the structure and it replaces at least some of the pneumatic supporting members.

It is expedient that the hollow slotted light guide is attached to the shell and pneumatic supporting members of the structure.

It is preferable that the ends of at least three hollow slotted light guides of a curvilinear shape converge at one point, whereas the opposite ends of said hollow slotted light guides are optically connected to respective optical input devices.

It is desirable that the hollow slotted light guide and the structure's shell form a single whole.

The end slot on the side surface of the hollow slotted light guide may be made from the material of the structure's shell; in this case, the light-permeable slot mut be hermetically connected to that portion of the hollow slotted light guide, which has the light-reflecting coating.

It is also expedient that the hollow slotted light guide should have at least one bend; and in each of said bends, there is installed a mirror for uniform propagation of the luminous flux over the entire length of the hollow slotted light guide.

The present invention simplifies the assembly of a lighting installation and the laying of an electric network; and it simplifies the design of a structure with pneumatic supporting members and ensures safety in cases of a drop of the gas pressure in the supporting members of the structure. The invention also dispenses with the suspension and bracing of large-size hollow slotted light guides, keeping in mind that along with the suspension and bracing, firm and rigid bases are required. The invention reduces the influx of heat from the light sources into the interior of the structure and provides a simple, centralized means for the release of excessive heat from the interior.

Other objects and advantages of the present invention will become more apparent from the following detailed description of preferred embodiments thereof which are better understood when read in conjunction with the accompanying drawings, wherein.

Figure 11A:
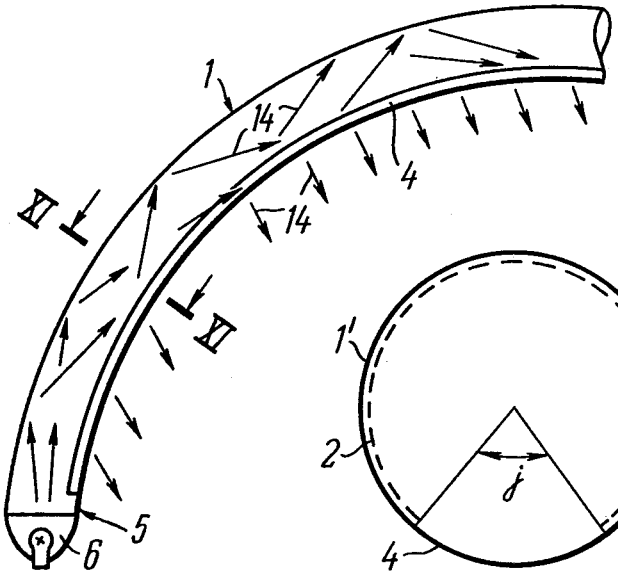
Figure 11B:
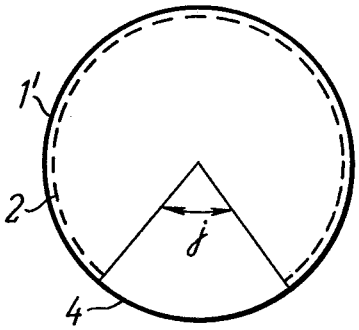

FIG. 11*a* is a partial side elevational view showing the passage of rays through a curvilinear hollow slotted light guide; and FIG. 11*b* is a sectional view taken along the line XI—XI of FIG. 11*a*.

Referring now to the drawings, the proposed installation for interior lighting of structures with pneumatic supporting members comprises a hollow slotted light guide 1 (FIG. 1) with a shell 1'. Part of the internal surface of said shell 1' is provided with a light-reflecting coating 2 with a high reflection factor. The shell 1' is of an elastic film; its part facing an interior 3 being illuminated is a light-permeable slot 4 made of a light-permeable film. Ends 5 of the hollow slotted light guide rest upon optical input devices 6 which may be, for example, floodlights, headlight lamps, or special optical input devices of the group type. The shape of the hollow slotted light guide 1 is maintained by an excess pressure of a gas, for example, air, produced with the aid of a compressor 7. Gas is directed into the hollow slotted light guide 1 through a ramified air duct 8 and inlet valves 9. The hollow slotted light guides 1 are attached to a shell 10 of a structure 11. The shell 10 is of a light-permeable polyethyleneterephthalate film, which makes it possible to use natural lighting in the day time.

Figure 2:
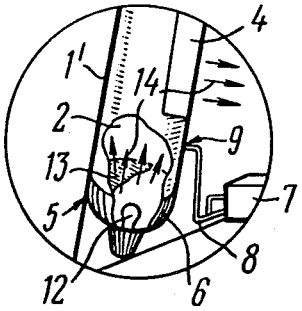
FIG. 2 is an enlarged fragmentary view of an end portion of a hollow slotted light guide with an optical input device.

FIG. 2 is an enlarged view of one of the ends 5 which is optically connected to the optical input device 6 housing a light source, for example, a metal halogen discharge lamp.

From a source 12, the luminous flux is directed through a window 13 of a transparent thermal-resistant material into the hollow slotted light guide 1. The direction of the luminous flux is shown by arrows 14.

Figure 3:
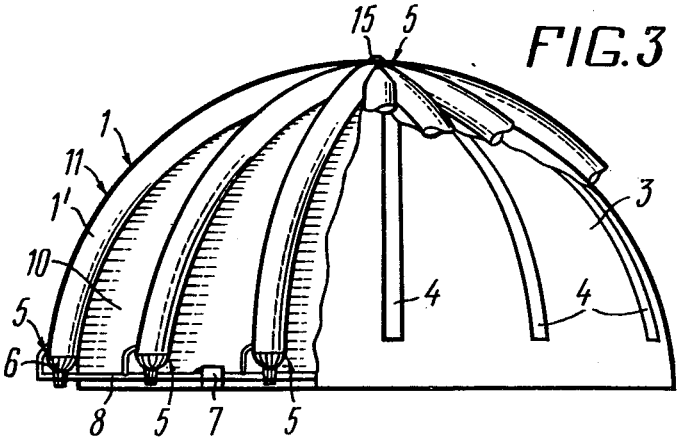
FIG. 3 is a side elevational view, partly broken away, of a cupola-arch, semispherical structure with a system of meridian hollow slotted light guides.

FIG. 3 is a view of a semispherical structure 11, wherein the meridian hollow slotted light guides 1 also serve as supporting and shaping members. One of the ends 5 of each hollow slotted light guide 1 is optically coupled to the optical input guides converging at one point 15. The above arrangement of the hollow slotted light guides ensures firmness of the entire structure 11 even without the shell 10; and in this case it is unnecessary to attach the shell 10 to the hollow slotted light guides 1, so the shell 10 may be simply stretched over to light guides 1. As a minimum, there must be three hollow slotted light guides 1 to guarantee the firmness of the structure of FIG. 3.

Figure 4:
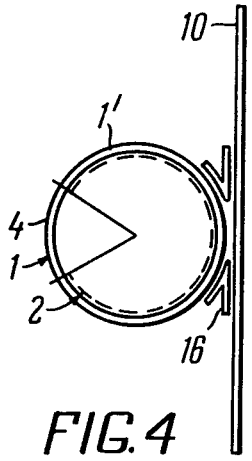
FIG. 4 is a schematic view illustrating a way of attaching a hollow slotted light guide to the shell of a structure.

FIG. 4 is a schematic cross-sectional view of the hollow slotted light guide 1 attached to the shell 10. The part of the shell 1' of the hollow slotted light guide 1, which has a light-reflecting coating, is attached to the shell 10 by means of an adhesive tape 16.

Figure 1:
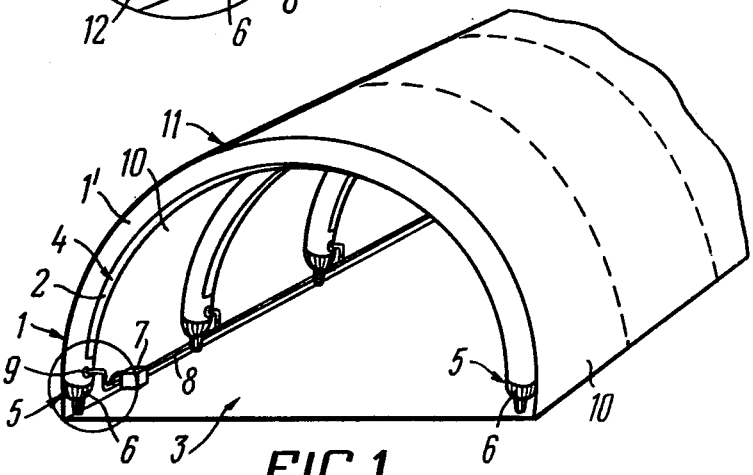
FIG. 1 is a partial perspective view of an arched structure, wherein hollow slotted light guides of a curvilinear shape are supporting and shaping members of the structure.
Figure 5:
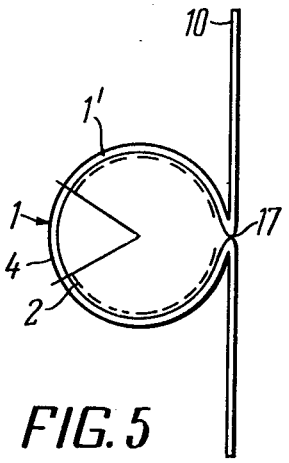
FIG. 5 is another schematic view of a hollow slotted light guide which is a single whole with the shell of a structure.

According to FIG. 5, the shell 10 is a single whole with the hollow slotted light guide 1, which is attached by ultrasonically welding said shell 10 to the light-reflecting coating 2, or through adhesion of said shell 10 along a seam 17. The embodiment of FIG. 5 increases the firmness of the structure 11 (FIG. 1).

Figure 6:
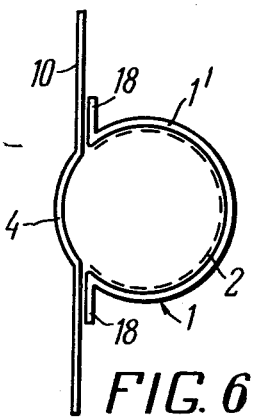
FIG. 6 is a schematic view showing an alternative way of attaching a hollow slotted light guide to the shell of a structure.

According to FIG. 6, the part of the shell 1' of the hollow slotted light guide 1, which is provided with the light-reflecting coating 2, is attached to the outer surface of the shell 10 of the structure 11 (FIG. 1) through welding or agglutinating beads 18 (FIG. 6) to the shell 10.

The light-permeable slot 4, which is of a light-permeable elastic film, is hermetically connected to the portion of the shell 1' having the light-reflecting coating; and said slot 4 is part of the shell 10 of the structure 11.

Figure 7:
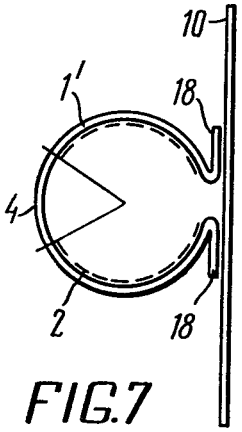
FIG. 7 is a schematic view showing another alternative way of attaching a hollow slotted light guide to the shell of a structure.

According to FIG. 7, the hollow slotted light guide 1 is inside the structure 11 (FIG. 1) and attached to the shell 10 (FIG. 7) by means of welding or glueing the beads 18 of the hollow slotted light guide 1 to the shell 10.

Figure 8:
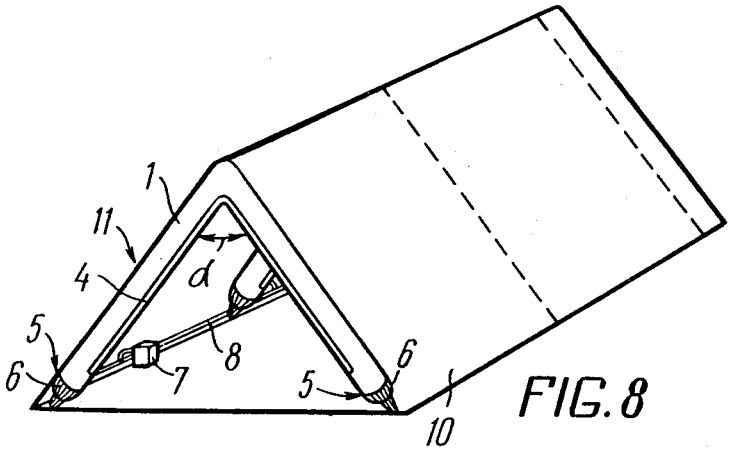
FIG. 8 is a perspective view of a V-shaped structure.

FIG. 8 is a perspective view of a V-shaped structure 11. The hollow slotted light guides 1, which support the structure 11, have one bending angle $\alpha$. It is necessary in this case that both ends 5 of the hollow slotted light guide 1 be optically connected to the optical input devices 6 in order to propagate the luminous flux throughout the hollow slotted light guide 1. The stability of the hollow slotted light guides 1 in a V-shaped structure 11 can only be guaranteed by attaching said light guides 1 to the shell 10.

Figure 9:
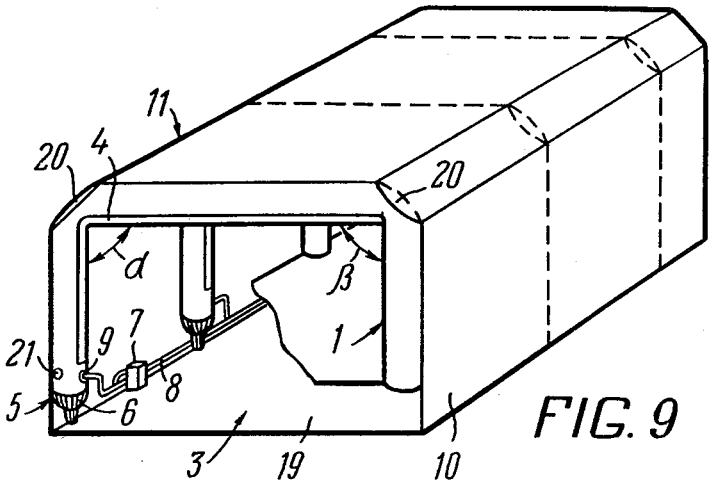
FIG. 9 is a perspective view of a structure shaped as an inverted U.

FIG. 9 shows in perspective a structure 11 which is shaped as an inverted U. The hollow slotted light guide 1 has two bending angles, $\alpha$ and $\beta$, which may be equal or different.

The optical input devices 6 are separated from the light guides 1 by the illuminators 13 (FIG. 2) and placed in recesses 19 (FIG. 9) provided in the floor of the premises 3; and as a result, the optical input devices 6 are protected from mechanical stresses.

In order to ensure propagation of the luminous flux, at the angles $\alpha$ and $\beta$, there are arranged mirrors 20; as a result, the optical input device 6 can be placed only at one end 5 of the hollow slotted light guide 1.

It is also desired to mount on the surface of the hollow slotted light guide 1 an outlet valve 21 so as to control or to reduce the air pressure inside the hollow slotted light guide 1.

Figure 10:
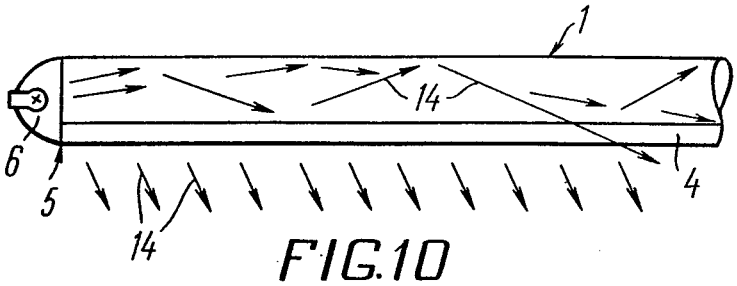
FIg. 10 is a partial side elevational view showing the passage of rays through a straight hollow slotted light guide.

The operating principle of the proposed lighting installation for interior lighting of structures with pneumatic supporting members is based upon the propagation of the luminous flux (see the arrows 14) due to its multiple reflections from the light-reflecting coating 2 (FIG. 10) provided on the internal surface of the shell 1' of the hollow slotted light guide 1. As the luminous flux passes along the hollow slotted light guide 1, part of it (see the arrows 14) is admitted through the light-permeable slot 4 into the interior 3 being lighted. When the optical input device 6 is located at one end 5 of the light guide 1 (FIG. 9), the ratio between the latter's maximum cross-sectional size and length is 20-50. The light-permeable slot 4 of the hollow slotted light guide 1 is of a light-diffusing film, which ensures a maximum uniformity in the distribution of the luminous flux throughout the volume of the interior 3 (FIG. 1).

In the curvilinear hollow slotted light guide 1 (FIG. 11*a*), the luminous flux travels as follows. First of all, in order to optimize the propagation of the luminous flux (see the arrows 14), the cross-section of the hollow slotted light guide 1 (FIG. 11*b*) is delineated by a smooth curve (so that said cross-section is either a circle or an ellipse); and the angular dimensions $\gamma$ of the light-permeable slot 4 must be 60° - 90°.

It should also be noted that the radius of curvature of the hollow slotted light guide 1 of a curvilinear shape must be at least eight times the minimum cross-sectional size of said hollow slotted light guide 1.

The lighting installation of the present invention operates as follows. From the lamps 12 (FIG. 2) arranged in the optical input devices 6, the luminous flux is directed through the ends 5 into the hollow slotted light guides 1 (FIG. 1) and admitted through the light-permeable slot 4 with sufficient uniformity into the interior 3 (FIG. 1), thereby producing the impression of luminous arches.

The shape of the hollow slotted light guide 1 is maintained by an excess pressure of air or other gas supplied by the compressor 7 through the air duct 8 and the inlet valve 9, mounted on the shell 1', inside the light guide 1.

Heated air is released from the hollow slotted light guide 1 through the outlet valve 21 (FIG. 9). This valve 21 reduces the pressure inside the light guide 1 if the air in it gets too hot.

If the shell 10 of the structure 11 is of a light-permeable material, the interior of said structure 11 is well lighted during the day time due to natural lighting. At night the interior is lighted by the proposed lighting installation.

The use of slotted light guides as supporting elements of structures sharply reduces the capital investments required for the construction and maintenance of various types of buildings due to te absence of the need for individual lighting fittings which have to be assembled and supplied with power. The invention facilitates maintenance and replacement of the light sources and minimizes the number of items that need maintenance or servicing. The invention also makes it possible to substantially improve the appearance of a lighting installation and the interior of a structure as a whole and provides both natural and artificial lighting of structures with pneumatic supporting members.

What is claimed is:

1. A lighting installation for interior lighting of structures having a covering shell and elastic pneumatic supporting members, comprising:

at least one elastic pneumatic hollow slotted light guide which is also a supporting and shaping member of said structure, said structure including a covering shell of an elastic film; a portion of the internal surface of said light guide having a light-reflecting coating; and the other portion of said light guide facing the interior being lighted is a light-permeable slot; said hollow slotted light guide having first and second end portions at least one optical input device mounted on at least one of said end portions of said hollow slotted light guide and optically coupled to said hollow slotted light guide;

at least one light source arranged in said optical input device which directs the luminous flux from said light source into said hollow slotted light guide;

at least one inlet valve for said hollow slotted light guide; and means for the supply of gas through said inlet valve into said hollow slotted light guide.

2. A lighting installation as claimed in claim 1, comprising:

at least three said hollow slotted light guides;

said first end portions of said hollow slotted light guides converging at one point which is raised above the ground; and said second end portions of said hollow slotted light guides being optically connected to said optical input devices.

3. A lighting installation as claimed in claim 1, wherein a plurality of said elastic pneumatic hollow slotted light guides and a plurality of said elastic pneumatic supporting members are employed in the support of said covering or shell of said structure.

4. A lighting installation as claimed in claim 3, wherein:

said hollow slotted light guides have at least one bend; and a mirror is arranged at said bends in order to ensure propagation of the luminous flux throughout the length of the hollow slotted light guides.

5. A structure having an interior to be lighted comprising:

a shell of an elastic film forming a covering of said structure;

pneumatic supporting members for said shell; and a lighting installation for lighting said interior, comprising:

an elastic pneumatic hollow slotted light guide which is also a supporting and shaping member of said structure said hollow slotted light guide, being made of an elastic film; a portion of the internal surface of said hollow slotted light guide having a light-reflecting coating, and the other portion of said light guide facing said interior to be lighted is a light-permeable slot; said hollow slotted light guide having first and second end portions at least one optical input device mounted on at least one end portion of said hollow slotted light guide and optically coupled to said hollow slotted light guide;

at least one light source arranged in said optical input device which directs the luminous flux from said light source into said hollow slotted light guide;

at least one inlet valve for said hollow slotted light guide; and means for the supply of gas through said inlet valve into the hollow slotted light guide.

6. A structure as claimed in claim 5, wherein said hollow slotted light guide is attached to said shell of said structure.

7. A structure as claimed in claim 6, wherein said hollow slotted light guide and said shell of said structure form a single whole.

8. A structure as claimed in claim 6, wherein said hollow slotted light guide is connected to said shell of said structure opposite to said light-permeable slot of said hollow slotted light guide.

9. A structure as claimed in claim 6, wherein said hollow slotted light guide has at least one bend, and a mirror for propagating the luminous flux over the entire length of said hollow slotted light guide is installed at said bend.

10. A structure as claimed in claim 6, wherein said hollow slotted light guide is hermetically connected to said shell of said structure and said light-permeable slot of said hollow slotted light guide is formed by part of the shell of said structure.

11. A structure as claimed in claim 10, wherein said shell is of a light-permeable material.

12. A structure as claimed in claim 11, wherein said shell is made from a polyethylene terephthalate film.

* * * * *